US007409771B2

(12) United States Patent
Bond

(10) Patent No.: US 7,409,771 B2
(45) Date of Patent: Aug. 12, 2008

(54) SELF SUPPORTING STRING LINE REEL-LINE BLOCK TOOL

(76) Inventor: William Ralph Bond, 4755 Asdee La., Woodbridge, VA (US) 22192

( * ) Notice: Subject to any disclaimer, the term of this patent is extended or adjusted under 35 U.S.C. 154(b) by 492 days.

(21) Appl. No.: 11/196,207

(22) Filed: Aug. 4, 2005

(65) Prior Publication Data

US 2007/0029433 A1 Feb. 8, 2007

(51) Int. Cl.
*G01C 15/06* (2006.01)

(52) U.S. Cl. ..... 33/409; 33/1 LE

(58) Field of Classification Search ..... 33/418, 33/409, 410, 407, 413, 404, 1 LE, 408; 242/537, 242/539

See application file for complete search history.

(56) References Cited

U.S. PATENT DOCUMENTS

| | | | | |
|---|---|---|---|---|
| 472,593 | A | 4/1892 | Tache | |
| 492,636 | A * | 2/1893 | Snyder | 33/409 |
| 1,094,286 | A | 4/1914 | Winstead | |
| 1,579,886 | A | 4/1926 | Oxner | |
| 1,630,475 | A | 5/1927 | Elder | |
| 1,814,389 | A | 7/1931 | Jacobsen | |
| 2,611,963 | A * | 9/1952 | Zinken | 33/408 |
| 2,647,321 | A * | 8/1953 | Hart et al. | 33/409 |
| 2,800,719 | A * | 7/1957 | Tuzicka | 33/409 |
| 2,833,043 | A * | 5/1958 | Patejdl, Jr. | 33/408 |
| 2,834,112 | A * | 5/1958 | Seagraves | 33/409 |
| 2,865,107 | A * | 12/1958 | Castano | 33/409 |
| 2,948,065 | A * | 8/1960 | Simonic | 33/409 |
| 3,408,742 | A * | 11/1968 | Caprio et al. | 33/409 |
| 3,555,688 | A * | 1/1971 | Smathers | 33/408 |
| 3,626,434 | A * | 12/1971 | Miller | 33/408 |
| 4,285,477 | A | 8/1981 | Oxendahl et al. | |
| 5,125,162 | A * | 6/1992 | Prebeck | 33/408 |
| 5,392,523 | A * | 2/1995 | Hurt | 33/408 |
| 6,036,133 | A | 3/2000 | Milligan | |
| 6,276,627 | B1 | 8/2001 | Brodock | |
| 6,412,184 | B1 | 7/2002 | Heavner | |
| 6,581,295 | B1 * | 6/2003 | Black | 33/369 |
| 6,964,109 | B1 * | 11/2005 | Bond | 33/414 |

* cited by examiner

*Primary Examiner*—Christopher W Fulton
(74) *Attorney, Agent, or Firm*—Palmer C. DeMeo

(57) ABSTRACT

A string line tool having a string line support and an integral line block for using a string line under tension in alignment work for carpentry, masonry and general construction work. The string line tool of this invention is self supporting due to maintaining the string line under tension between the string line tool at one end of a string line and a fastening means at the opposite end of the string line via the intermediary of a grooved line block.

21 Claims, 4 Drawing Sheets

SELF SUPPORTING STRING LINE REEL-LINE BLOCK TOOL

BACKGROUND OF THE INVENTION

1. Field of the Invention

The present invention relates to a string line for alignment work in carpentry, masonry and general construction.

2. Description of the Related Art

String line reels are conventionally used in construction work to provide a visible line by which the construction worker can use for aligning multiple construction units, e.g., bricks or cinder blocks. An old and well known string line reel is disclosed in the Oxendahl patent U.S. Pat. No. 4,285,277 whereby a string line is wound on a cord bearing head rotatably disposed on an elongated handle. However, the string line reel disclosed in this patent requires some extra work on the part of the construction worker in the fixing of the free end of the string line to the construction work and the holding of the string line reel at the opposite end of the string line when it is deployed. In other words, the string line reel is not self supporting. The patent to Winstead U.S. Pat. No. 1,094,286 does, however, disclose a string line reel and holder which is self supporting when in use. The string line in this patent is wound around a hand rotatable reel at one end and is fixed to a support at its opposite end. When in use, the string line is placed on a wall or other surface and becomes strained between the rotatable reel and the opposite support and therefore, the system is self supporting. The Heavner patent U.S. Pat. No. 6,412,184 discloses the use of line blocks and respective line holders located at opposite ends of a brick wall to stretch respective guide lines or string lines between opposing ends of the brick wall in order to maintain proper placement and alignment of brick courses. The line blocks in the Heavner patent are disclosed as being T-shaped. In this patent, the string line is under tension when the line blocks and line holders are used in the system. However, the line holders in this patent are neither shown nor disclosed.

SUMMARY OF THE INVENTION

The main purpose of this invention is to eliminate a second person or need of a fastener when using a string line reel for construction projects. In order to do this, a self supporting string line reel-line block tool (hereafter, string line tool) is provided which is easily manipulated by a construction worker, such as, in the alignment of cinder blocks or bricks. The string line tool of this invention combines the features of a string line reel and a string line block. The string line reel and string line block are combined in a unitary structure which facilitates the alignment of construction units, e.g., cinder blocks or bricks, by a single construction worker without the necessity of providing a fastener at the free end of the string line. The invention unites a hand held, rotatable string line reel with a uniquely positioned string line block into a single unit whereby the construction worker can place an L-shaped tab, at the free end of the string line reel, at one end of the construction structure, pull the combined string line reel and line block along the length of the structure while keeping the string line under tension and finally hooking the line block onto an opposite end of the construction structure.

Thus, it is an object of this invention to provide a string line tool which will facilitate the alignment of construction units.

It is another object of this invention to save work time of the construction worker in the use of this unique tool.

Other objects and advantages in the use of the string line tool of this invention will become apparent upon reading the following description of which the attached drawings form a part.

DETAILED DESCRIPTION OF THE PREFERRED EMBODIMENT

Figure 2:
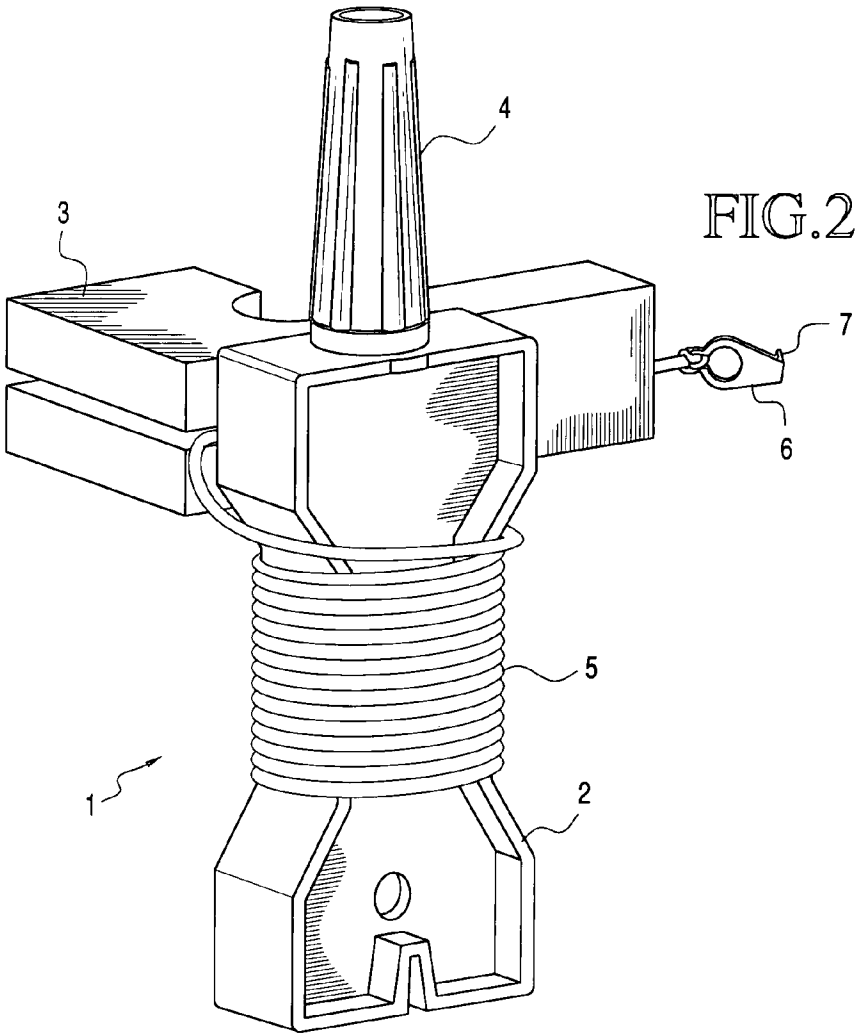
FIG. 2 is a rear perspective view of FIG. 1.
Figure 1:
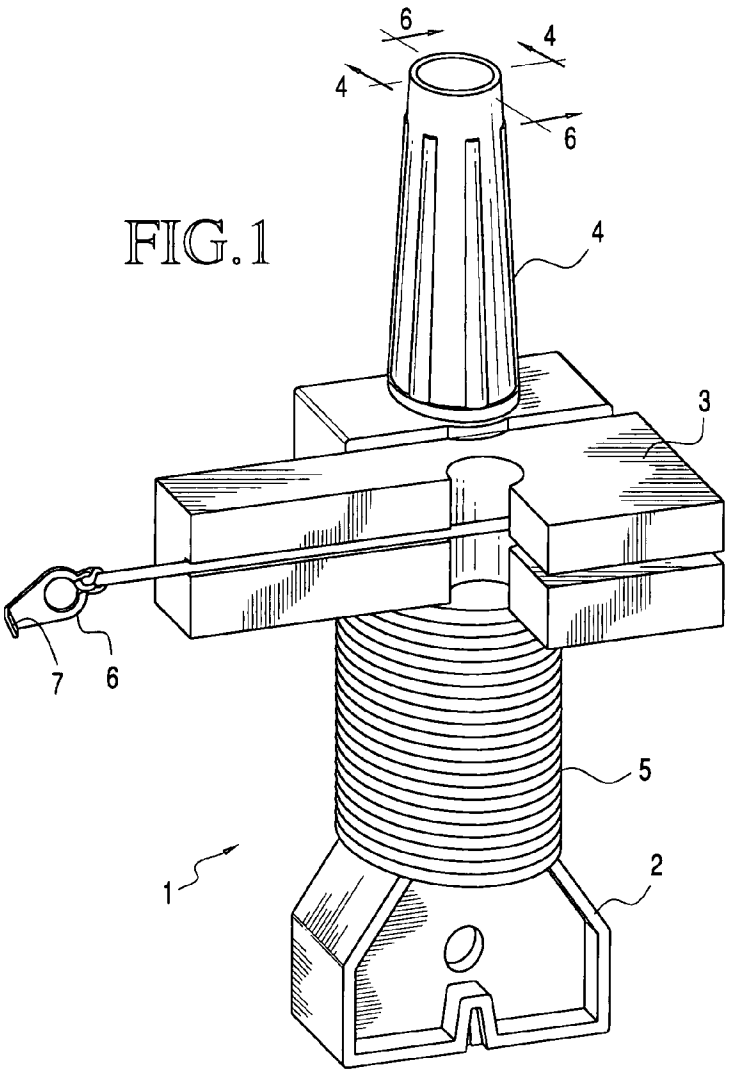
FIG. 1 is a front perspective view of the string line tool of this invention with the string line wound thereon.
Figure 3:
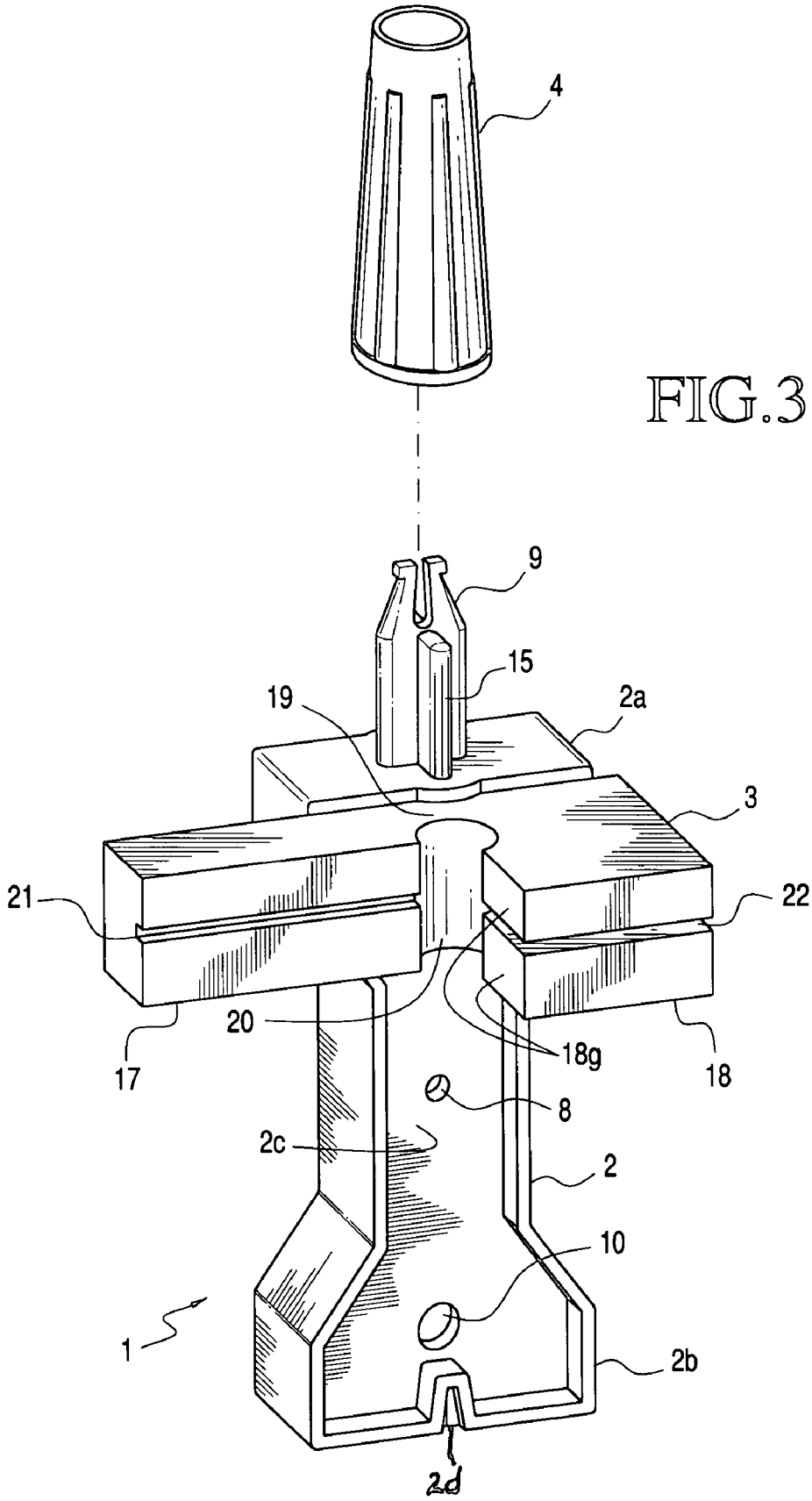
FIG. 3 is a front perspective view of the string line tool of this invention without the attached string line and with the handle elevated above its support.

Referring to FIGS. 1, 2, and 3 there is shown a string line tool 1 of this invention. The string line tool 1 is made up from an elongate support member 2 with an L-shaped line block 3 integral with one end of the support member 2 and a removable handle 4 at the same end. A string 5 is wrapped around the central portion of the support member 2. A stretchable string 5, commonly used by brick masons, is used for this string line tool 1. The string 5 generally has a length of between 100-300 feet. A metal tab 6 having an extending hook 7 is attached to the free end of the string 5 and the opposite end of the string 5 is knotted to a hole 8 in the central portion of the support member 2. Although metal is preferred for tab 6 other materials such as hard plastic or rubber may also be used in lieu thereof. Also integral with the top end of the support member 2 is an elongate handle support 9 for the handle 4. There is a somewhat larger hole 10 near the bottom end of the support member 2; this hole 10 is used for hanging the string line tool 1 in a storage condition. The overall longitudinal length of the support member 2 with its attached handle 4 is approximately 7 inches. The width of each wing 2*a*, 1*b* at the opposite ends of the support member 2 is approximately 2 and ¼ inches. The width of the central portion 2*c* of the support member 2 is approximately 1 inch. The major part of the central portion 2*c* has a flat surface. A sufficiently narrow groove 2*d* is provided at the end of wing 2*b* in order to secure the free end of the string 5 when the string line tool 1 is not being used. The thickness of the support member 2 can vary from 1/16 inch to ½ inch. The length of the handle 4 is approximately 2 and ½ inches and has a tapered inner diameter of approximately ½ inch at its smaller or top end and approximately ⅝ inch at its larger or bottom end. The length of the handle support 9 is 2 inches. The length of the ribs 15 and 16 of the handle support 9 is approximately 1 and ⅝ inches.

Figure 4:
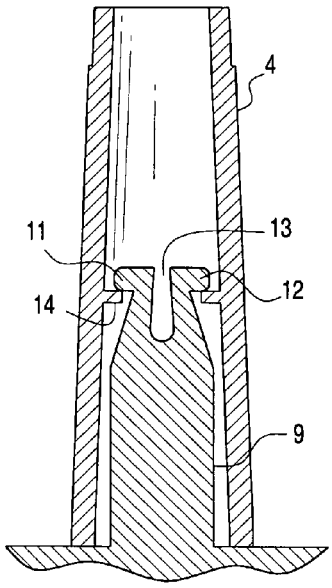
FIG. 4 is a partial cross-sectional view taken along lines 4, 4 in FIG. 1.
Figure 5:
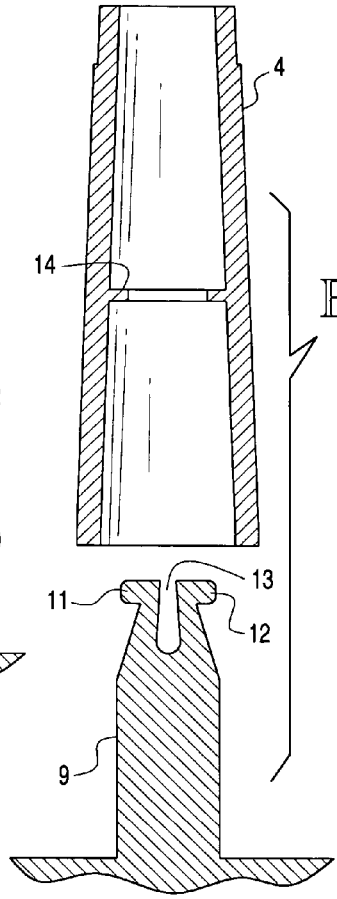
FIG. 5 is similar to FIG. 4 but with the handle removed from its support.
Figure 6:
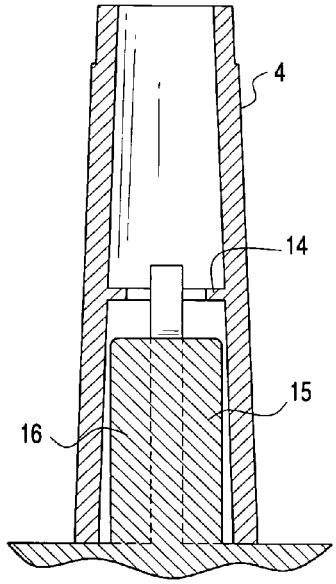
FIG. 6 is a partial cross-sectional view taken along lines 6, 6 in FIG. 1.
Figure 7:
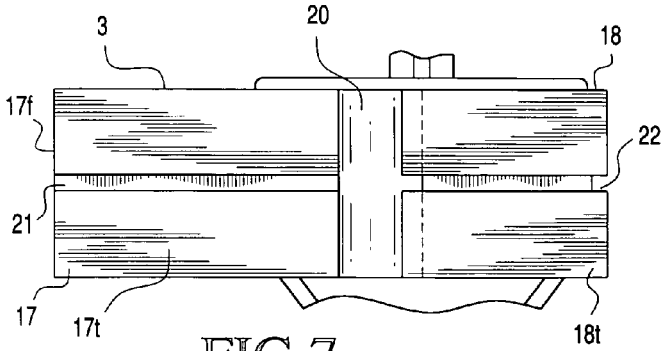
FIG. 7 is a partial top planar view of the line block of the string line tool.
Figure 8:
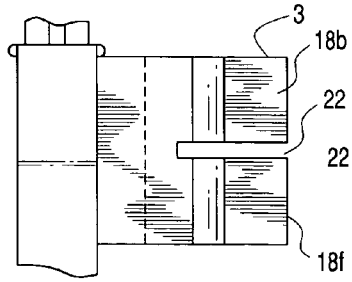
FIG. 8 is a partial bottom planar view of the line block of the string line tool.

FIGS. 4, 5, and 6 give a more detailed showing of the handle 4 and its support 9. The handle 4 is slipped down over the support 9 and the rim 14 on the inner surface of the handle 4 is forced over a pair of somewhat resilient L-shaped fingers 11 and 12 extending from the free end of the support 9 thereby firmly attaching the handle 4 to the support member 2 and allowing the support member 2 to be rotatable relative to the handle 4. The rim 14 is approximately 1 and ⅞ inches from the bottom of the handle 4 and has an inner diameter of approximately ⅜ inch. The fingers 11 and 12 are separated by a U-shaped space 13. In FIG. 5 there is shown a pair of ribs 15 and 16 which form part of the elongate handle support 9. These ribs 15 and 16 aid in stabilizing the handle 4 while the support member 2 is being rotated. The handle 4 may be removed from the support member 2 for certain construction jobs by prying one of the fingers 11, 13 inwardly (for example, by an appropriate screw driver) so that the handle 4 can be slipped out from the elongate support 9.

The important feature of this invention is the operation of the line block 3 which is made integral with the string line support member 2. Referring now to FIGS. 1, 2, 3, 6, 7 and 8, there is shown a line block 3 which is approximately L-shaped having a first leg section 17 and a second leg section 18 joined by an intermediate section 19. The second leg section 18 of line block 3 overlaps the adjacent end of wing 2*a* by approximately ¼ inch. The longitudinal length of the three contiguous sections 17, 18 and 19 is approximately 4 inches. There is an arcuate opening 20 adjacent the intermediate section 19 between the first and second leg sections 17 and 18. The center of the arcuate opening 20 is located approximately 1 and ½ inches from the free longitudinal end of the second leg section 18. The arcuate opening 20 has a radius of approximately ¼ inch. There is a shallow groove 21 in the top side 17*t* of the first leg section 17 of the line block 3. The groove 21 has a depth of approximately 1/16 inch and runs longitudinally from the free end 17*f* of the first leg section 17 to the circumference of the arcuate opening 20. The length of the groove 21 is approximately 2 and ⅛ inch. The depth of the groove 21 should be deep enough to accommodate the sliding of the string 5 therein and therethrough. There is another groove 22 in the top side 18*t* of the leg section 18. This groove 22 extends all the way through from the top side 18*t* of the leg section 18 to the bottom side 18*b* of the leg section 18 for a longitudinal distance of approximately ⅞ inch from the free end 18*f* of leg section 18. The same groove 22 extends partially through from the top side 18*t* of the leg section 18 down to approximately midway of the arcuate opening 20 and ends at the circumference of the arcuate opening 20. The bottom of this part of the groove 22 coincides with the bottom of groove 21 in the first leg section 17. The two front flat inner surfaces 18*g* of leg section 18 may have non-skid material, e.g., rubber, attached thereto in order to prevent the string line tool 1 from slipping off the construction piece to which it is to be attached when applied for a particular construction project. The non-skid material may be attached to the surfaces 18*g* either as flat pieces by an adhesive means, for example, or as solid elements imbedded therein.

The string line tool 1 of this invention may be made from plastic, metal or wood. Plastic is preferred, for example, AVS plastic. The manufacture of the string line tool 1 of this invention is done by injection molding. Both the support member 2 and the line block 3 are joined together as a single unit by injection molding and the handle 4 is also made by injection molding. Alternatively, the support member 2 and the line block 3 may be made separately by injection molding and then attached to each other by some appropriate fastening means, e.g., screw(s), adhesive, fusion, etc.

Figure 9:
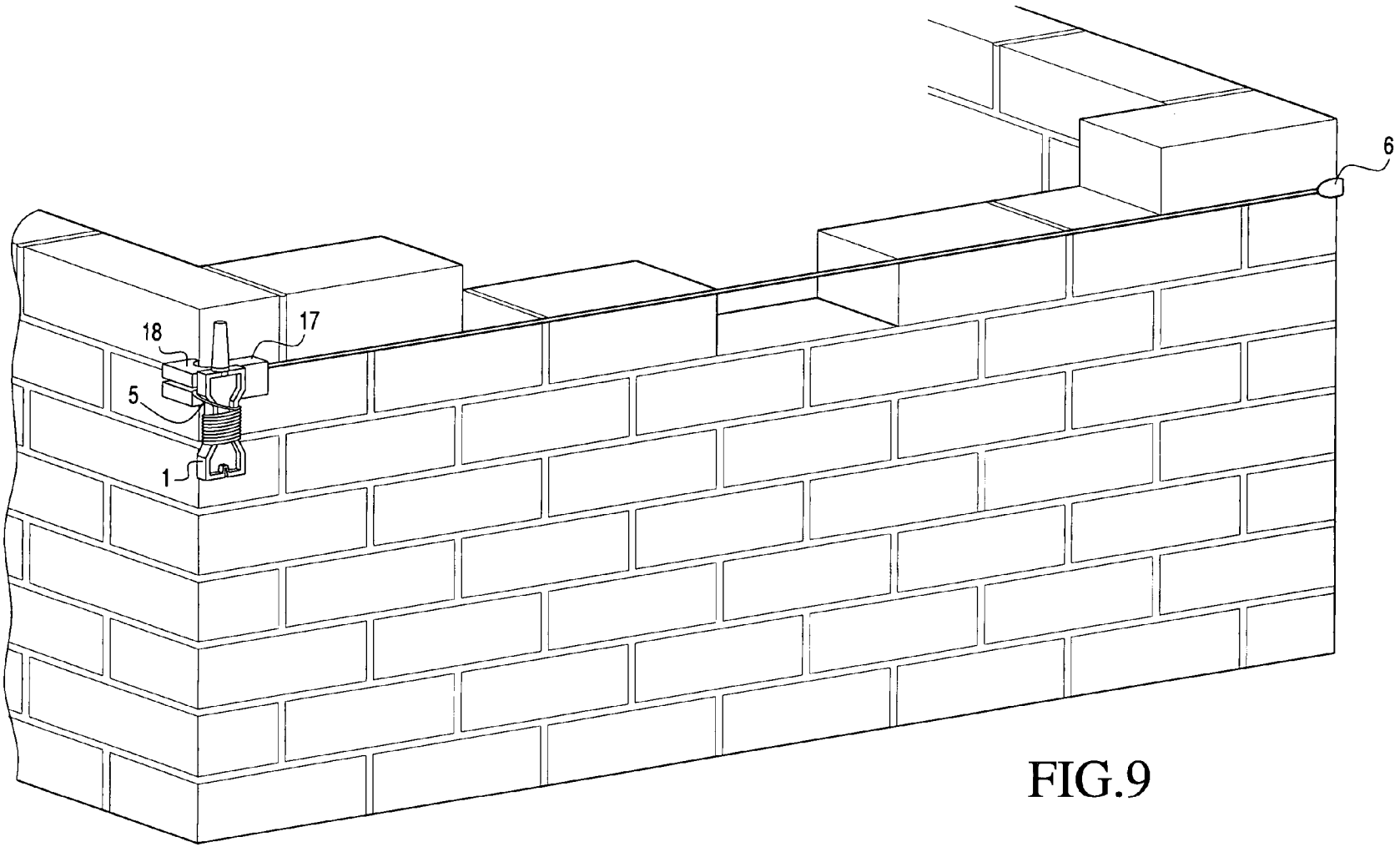
FIG. 9 shows the string line tool of this invention applied in the construction of a brick wall.

An example of an application of the string line tool 1 of this invention is now explained with reference to FIG. 9 showing the construction of a brick wall and the alignment of the bricks in the courses of the wall. Assuming that the right and left hand corners of the brick wall are already built using the conventional level and plumb, the procedure will now be explained for positioning the string line tool 1 by going from the right hand corner of the brick wall to the left hand corner of the brick wall. The procedure of positioning the string line tool 1 on the brick wall is also applicable by going in the reverse direction. The construction worker must first hook the metal tab 6 on the right hand corner of the brick wall at the desired height on the wall for alianment of the next or succeeding course of bricks. He then pulls the string line tool 1 towards the opposite end of the wall and keeping the string 5 under tension until he reaches the opposite end of the brick wall at which point he threads the string 5 through grooves 22 and 21 (consecutively) in the line block 3 and then hooks the line block 3 on the opposite end of the brick wall. Should the worker overshoot the opposite end of the wall with a small amount of string 5, he can wrap the excess string 5 sufficiently around the tool 1 through the arcuate opening 20 of the line block 3 so that the string 5 remains under tension; this is done prior to threading the string 5 through grooves 22 and 21 of the line block 3. The string line tool 1 in this condition is self-supporting on the wall. The construction worker is then able to align the next or successive course of bricks. For safety reasons, excessive tension should not be exerted on the string 5 when carrying out this procedure since the tab 6 could be yanked free from the corner of the wall. Although a tab 6 is tied to the free end of the string 5 in this procedure, the free end of the string 5 could also be tied to a line pin (used by masons) or to a standard line block. If posts are used at opposite ends of the wall, then the free end of the string 5 could be tied to a nail in the post or tied around the post itself. When rewinding the string 5 after a particular application, it should be rewound so that it is evenly distributed over the central portion 2*c* of the support 2.

Modification of this invention will be readily apparent to those skilled in the art and it is intended that the invention be not limited by the embodiments disclosed herein but that the scope of the invention be defined by the appended claims.

What is claimed is:

1. A string line tool comprising a string line reel and a line block, said string line reel comprising an elongated support member having a first end and a second end, and an intermediate section therebetween, a first longitudinal axis extending between said first and second ends and passing through said intermediate section, an elongated handle support attached to and extending from said first end along said first longitudinal axis, a handle surrounding said elongated handle support, a line block having an approximate L-shape and being attached solely and fixedly to said first end of said string line reel, said line block having a first leg portion and a second leg portion, said first and second leg portions being interconnected by a third portion, a second longitudinal axis passing through said first leg portion, said second leg portion, and said third portion of said line block, said line block being attached laterally to said first end of said elongated support member such that said second longitudinal axis is perpendicular to said first longitudinal axis, a groove extending longitudinally through each of said first leg portion and said second leg portion and along said second longitudinal axis, a string line attached to and wound around said intermediate section of said string line reel, said string line having a free end, and said string line passing through said groove when said string line tool is being used for a particular application.

2. The string line tool of claim 1 wherein said first leg portion is longer than said second leg portion.

3. The string line tool of claim 1 wherein there is an open space curvature formed between said first and second leg portions and proximate said third portion.

4. The string line tool of claim 3 wherein said second leg portion has a vertical height greater than said first leg portion and has a lateral extension partially overlapping said open space curvature.

5. The string line tool of claim 3 wherein said first leg portion has an elongated flat surface thereon with said groove therein, said groove in said first leg portion being a shallow groove, said groove in said second leg portion being a deep groove, said groove in each of said first leg portion and said second leg portion facing away from the attachment of said line block to said string line reel, the bottom of each of said grooves being collinear with each other, and wherein said open space curvature extends below said groove in each of said first leg portion and said second leg portion.

6. The string line tool of claim 1 wherein said groove in said first and second leg portions faces away from the attachment of said line block to said string line reel.

7. The string line tool of claim 6 wherein said first leg portion has an elongated flat surface thereon with said groove therein and said second leg portion has a pair of planar surfaces perpendicular to said elongated flat surface of said first leg portion.

8. The string line tool of claim 7 wherein said planar surfaces have rubber pads attached thereto.

9. The string line tool of claim 7 wherein said planar surfaces have rubber elements attached to or embedded therein.

10. The string line tool of claim 1 wherein said string line reel and said line block are integrally attached.

11. The string line tool of claim 1 wherein said string line tool is made from plastic, metal or wood.

12. The string line tool of claim 11 wherein said string line tool is plastic.

13. The string line tool of claim 12 wherein said string line tool is an injection molded plastic.

14. The string line tool of claim 1 wherein said string line reel and said line block are integral and form a unitary structure.

15. The string line tool of claim 14 wherein said handle is somewhat cone-shaped and hollow and there is a circular rim on the inner surface of said handle.

16. The string line tool of claim 15 wherein said handle support has a pair of spaced, hook-shaped fingers at the free end thereof which fingers will engage said circular rim when said handle is pushed down onto and over said handle support.

17. The string line tool of claim 1 wherein said free end of said string line is tied to a tab with a hooked extension.

18. The string line tool of claim 1 wherein said elongated handle support has a pair of elongated ribs opposite each other.

19. The string line tool of claim 1 wherein said string line reel and said line block are attached to each other by fastening means.

20. The string line tool of claim 19 wherein said fastening means are screws, adhesives or fusion.

21. The string line tool of claim 1 wherein said string line is stretchable.

* * * * *